US006686112B2

(12) United States Patent
Teshima et al.

(10) Patent No.: US 6,686,112 B2
(45) Date of Patent: Feb. 3, 2004

(54) ELECTROPHOTOGRAPHING DRY-TYPE TONER AND PRODUCTION METHOD THEREFOR

(75) Inventors: Takashi Teshima, Nagano-Ken (JP); Masaki Kato, Nagano-Ken (JP); Takatomo Fukumoto, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 90 days.

(21) Appl. No.: 09/959,952

(22) PCT Filed: Mar. 7, 2001

(86) PCT No.: PCT/JP01/01754

§ 371 (c)(1),
(2), (4) Date: Nov. 13, 2001

(87) PCT Pub. No.: WO01/67183

PCT Pub. Date: Sep. 13, 2001

(65) Prior Publication Data

US 2002/0160289 A1 Oct. 31, 2002

(30) Foreign Application Priority Data

| | | |
|---|---|---|
| Mar. 10, 2000 | (JP) | 2000-066300 |
| Mar. 15, 2000 | (JP) | 2000-072335 |
| Mar. 1, 2001 | (JP) | 2001-056192 |

(51) Int. Cl.[7] ..... G03G 9/08

(52) U.S. Cl. ..... 430/110.1; 430/108.1; 430/108.8; 430/137.1; 430/137.11

(58) Field of Search ..... 430/110.1, 108.1, 430/108.8, 137.1, 137.11

(56) References Cited

U.S. PATENT DOCUMENTS

| | | | | |
|---|---|---|---|---|
| 5,354,640 A | | 10/1994 | Kanbayashi et al. | |
| 5,981,129 A | * | 11/1999 | Akazawa et al. | 430/137.11 |
| 6,022,661 A | * | 2/2000 | Kurose et al. | 430/109.1 |
| 6,436,599 B1 | * | 8/2002 | Matsuoka et al. | 430/111.4 |

FOREIGN PATENT DOCUMENTS

| | | | | |
|---|---|---|---|---|
| JP | 2-62558 | | 3/1990 | |
| JP | 4-3171 | | 1/1992 | G03G/9/087 |
| JP | 4-182669 | | 6/1992 | |
| JP | 4-307558 | | 10/1992 | |
| JP | 6-77161 | | 9/1994 | G03G/9/087 |
| JP | 8-12451 | | 2/1996 | G03G/9/08 |
| JP | 8-124753 | | 5/1996 | H01F/27/04 |
| JP | 8-254853 | | 10/1996 | |
| JP | 10-301325 | | 11/1998 | |
| JP | 11174724 A | * | 7/1999 | G03G/9/08 |
| JP | 11-305487 | | 11/1999 | |

OTHER PUBLICATIONS

Abstract JP4003171, Jan. 8, 1992.
Abstract JP8124753, May 17, 1996.
International Search Report (4/01).

* cited by examiner

*Primary Examiner*—Christopher Rodee
(74) *Attorney, Agent, or Firm*—Sughrue Mion, PLLC

(57) ABSTRACT

The present invention provides an electrophotographic dry toner comprising colored resin particles with releasing agent particles dispersed in a binder resin or an electrophotographic dry toner wherein a resin coating layer obtained by the fixation and fusion of encapsulating resin particles is provided on the surface of colored resin particles with releasing agent particles dispersed in a binder. The releasing agent particles dispersed in each colored resin particle have a particle diameter distribution such that the particle diameter of releasing agent particles dispersed in the vicinity of the surface of each colored resin particle is larger than the particle diameter of releasing agent particles at a central site of the colored resin particle. Alternatively, the colored resin particle is coated with the releasing coating layer with a releasing agent layer interposed between them. The electrophotographic dry toner is improved in terms of offset resistance on fixation and durability with no contamination due to filming of process members such as photosensitive materials and developers. The invention also provides a process for the production of a color toner improved in terms of transparency with a reduced amount of free fine powders.

6 Claims, 1 Drawing Sheet

ELECTROPHOTOGRAPHING DRY-TYPE TONER AND PRODUCTION METHOD THEREFOR

BACKGROUND OF THE INVENTION

The present invention relates to a dry toner for electrophotography, and its production process as well.

A dry toner is usually produced by dispersing various agents such as releasing, coloring and charge control agents in a binder resin, grinding the resultant dispersion to toner size by fine grinding means, and classifying the powders into toner particles. Depending on the development system used, the dry toner is broken down into a one-component toner and a two-component toner comprising toner particles and carrier particles. A composite type toner is also known, in which the toner is coated thereon with a resin particle layer for the purposes of improving heat resistance, etc.

In recent years, faster operations and lower-temperature fixation than ever before have been required for electrophotography. To meet such demands, there are interal dispersion type oilless fixing toner particles wherein releasing agent particles are dispersed in a binder resin. However, it is required to prevent offsets such as particle deposition onto a fixing roller because of a decrease in the internal cohesive force upon melting of the binder resin. There is still no choice but to increase the content of the releasing agent. However, the incorporation of more releasing agent than required leads to a drop of the transparency of color toner.

For instance, JP-B 08-12451 discloses a toner composition production process, and Example 1 shows a toner composition consisting of 70% by weight of binder resin that is styrene-butadiene resin, 20% by weight of wax and 10% by weight of pigment. Referring to the shape of toner particles, the publication shows a toner particle comprising a continuous shell layer encapsulated with a waxy substance by heat treatment and less susceptible to produce frictional debris. However, it is expected that the encapsulating waxy substance contained in an amount of 28% by weight per 100 parts by weight of the binder resin causes process members such as photosensitive materials and developers to be contaminated by filming. Much wax offers a transparency problem.

JP-B 06-77161 discloses toner particles having uniform surfaces by "rounding" ground and classified core particles by means of heat treatment, a jet mill, an impact mill or the like, and then uniformly fixing shell particles to the core particles by means of mechanical impact, and shows a process using an impact mill as an example. In the example, however, the shell particles are struck in, or otherwise simply fixed to, toner particles that are the core particles with a waxy substance or the like dispersed therein. Consequently, the shell particles are susceptible to detachment, offering several problems such as scattering in copying machines, contamination, image blurring, etc.

JP-B 08-12453 discloses a toner wherein micro-particles are deposited onto the surface of a suspension-polymerized core particle in water using a water-soluble polymerization initiator, and shows that by using micro-particles having a specific glass transition temperature or softening point and adding a releasing agent to the core particles, especially the micro-particles, it is possible to provide toners excellent in heat resistance, offset resistance and optical transmission and so well fit for color toners. Only by use of the micro-particles combined with the releasing agent, however, releasing agent particles remain partly at the surface of the toner particle, causing filming onto a photosensitive material and contamination of members in a developer. Thus, problems such as defective images or early member replacement remain still unsolved.

A primary object of the present invention is to provide an electrophotographic dry toner which prevents contamination by filming of process members such as photosensitive materials and developers and is improved in terms of offset resistance on fixation as well as robustness and transparency with a reduced amount of free fine powders, and so lends itself to a color toner in particular, and a process for producing the same.

SUMMARY OF THE INVENTION

According to the first aspect of the present invention, there is provided a dry toner for electrophotography comprising colored resin particles with releasing agent particles dispersed in a binder resin, characterized in that the releasing agent particles dispersed in each colored resin particle have a particle diameter distribution such that the particle diameter of releasing agent particles dispersed in the vicinity of the surface of each colored resin particle is larger than the particle diameter of releasing agent particles at a central site of the colored resin particle.

This dry toner for electrophotography is further characterized in that the aforesaid colored resin particles have an average particle diameter of 3 $\mu$m to 10 $\mu$m and a circularity of 0.93 to 0.99 and the releasing agent particles dispersed in the vicinity of the surface of each colored resin particle have a particle diameter of 0.05 $\mu$m to 0.3 $\mu$m.

According to the second aspect of the present invention, there is provided a dry toner for electrophotography comprising colored resin particles with releasing agent particles dispersed in a binder resin, and encapsulating resin particles fixedly fused to the surface of each colored resin particle to form a resin coating layer thereon, characterized in that the releasing agent particles dispersed in each colored resin particle have a particle diameter distribution such that the particle diameter of releasing agent particles dispersed in the vicinity of the surface of each colored resin particle is larger than the particle diameter of releasing agent particles at a central site of the colored resin particle.

This dry toner for electrophotography is further characterized in that the aforesaid colored resin particles have an average particle diameter of 3 $\mu$m to 10 $\mu$m and a circularity of 0.93 to 0.99, the releasing agent particles dispersed in the vicinity of the surface of each colored resin particle have a particle diameter of 0.05 $\mu$m to 0.3 $\mu$m, and the resin coating layer has a thickness of 0.05 $\mu$m to 1 $\mu$m.

According to the third aspect of the present invention, there is provided a dry toner for electrophotography comprising colored resin particles with releasing agent particles dispersed in a binder resin, and encapsulating resin particles fixedly fused to the surface of each colored resin particle to form a resin coating layer thereon, characterized in that each colored particle is coated with a resin coating layer with a releasing agent layer interleaved therebetween.

This dry toner for electrophotography is further characterized in that the aforesaid encapsulating resin particles are obtained by soap-free emulsion polymerization.

Furthermore, the dry toner for electrophotography is characterized in that the aforesaid resin coating layer has a thickness of 0.05 $\mu$m to 1 $\mu$m and the aforesaid releasing layer has a thickness of 0.001 $\mu$m to 0.01 $\mu$m.

Moreover, the dry toner for electrophotography is characterized in that the aforesaid binder resin has a flow softening point of 100° C. to 150° C., there is a difference of up to ±30° C. between the softening point of the releasing agent and the flow softening temperature of the binder resin, and the flow softening temperature of the resin coating layer is at least 5° C. higher than the flow softening temperature of the binder resin.

The process for producing the first dry toner for electrophotography according to the present invention is characterized by comprising the steps of adding 0.5 parts by weight to 10 parts by weight of a releasing agent non-compatible with a binder resin to 100 parts by weight of the binder resin and dispersing the releasing agent therein with a coloring agent added thereto, then grinding the resultant dispersion by fine grinding means into colored resin particles, and finally treating the colored resin particles in a hot-air stream for their re-dispersion so that the releasing agent particles dispersed in each colored resin particle have a particle diameter distribution such that the particle diameter of releasing agent particles dispersed in the vicinity of the surface of each colored resin particle is larger than the particle diameter of releasing agent particles at a central site of the colored resin particle.

The process for producing the second dry toner for electrophotography according to the present invention is characterized by comprising the steps of adding 0.5 parts by weight to 10 parts by weight of a releasing agent non-compatible with A binder resin to 100 parts by weight of the binder resin and dispersing the releasing agent therein with a coloring agent added thereto, then grinding the resultant dispersion by fine grinding means into colored resin particles, then uniformly fixing encapsulating resin particles onto the surface of the colored resin particles by mechanical impact or a dry mechanochemical method and finally treating the colored resin particles in a hot-air stream so that the encapsulating resin particles are fused onto the surface of the colored resin particles to form a resin coating layer thereon, and the releasing agent particles dispersed in each colored resin particle have a particle diameter distribution such that the particle diameter of releasing agent particles dispersed in the vicinity of the surface of each colored resin particle is larger than the particle diameter of releasing agent particles at a central site of the colored resin particle.

The process for producing the third dry toner for electrophotography according to the present invention is characterized by comprising the steps of adding 0.5 parts by weight to 10 parts by weight of a releasing agent non-compatible with a binder resin to 100 parts by weight of the binder resin and dispersing the releasing agent therein with a coloring agent added thereto, then grinding the resultant dispersion by fine grinding means into colored resin particles, then uniformly fixing encapsulating resin particles onto the surface of the colored resin particles by mechanical impact or a dry mechanochemical method and finally treating the colored resin particles in a hot-air stream so that the encapsulating resin particles are fused onto the surface of the colored resin particles to form a resin coating layer thereon, and the colored resin particles are coated with the resin coating layer with a releasing agent layer interleaved therebetween.

The process of producing the fourth dry toner for electrophotography according to the present invention is characterized by comprising the steps of adding 0.5 parts by weight to 10 parts by weight of a releasing agent non-compatible with a binder resin to 100 parts by weight of the binder resin and dispersing the releasing agent therein with a coloring agent added thereto, then grinding the resultant dispersion by fine grinding means into colored resin particles, then heating the colored resin particles in a hot-air stream at a temperature higher than the melting point of the releasing agent to form a releasing agent layer on their surfaces, and finally uniformly fixing encapsulating resin particles onto the surface of the colored resin particles by mechanical impact or a dry mechanochemical method.

The first, second and third dry toners for electrophotography according to the present invention and their production processes ensure to provide a toner which prevents contamination by filming of process members such as photosensitive materials and developers, and has improved offset resistance, robustness and transparency upon fixation. The dry toner for electrophotography obtained by the fourth production process of the present invention provides a useful color toner improved in terms of transparency with a reduced amount of free dust.

BRIEF EXPLANATION OF THE DRAWING

A single drawing is a photograph illustrative of the particle structure in section of the dry toner for electrophotography prepared in Example 1 of the present invention.

BEST MODE OF CARRYING OUT THE INVENTION

Figure 1:
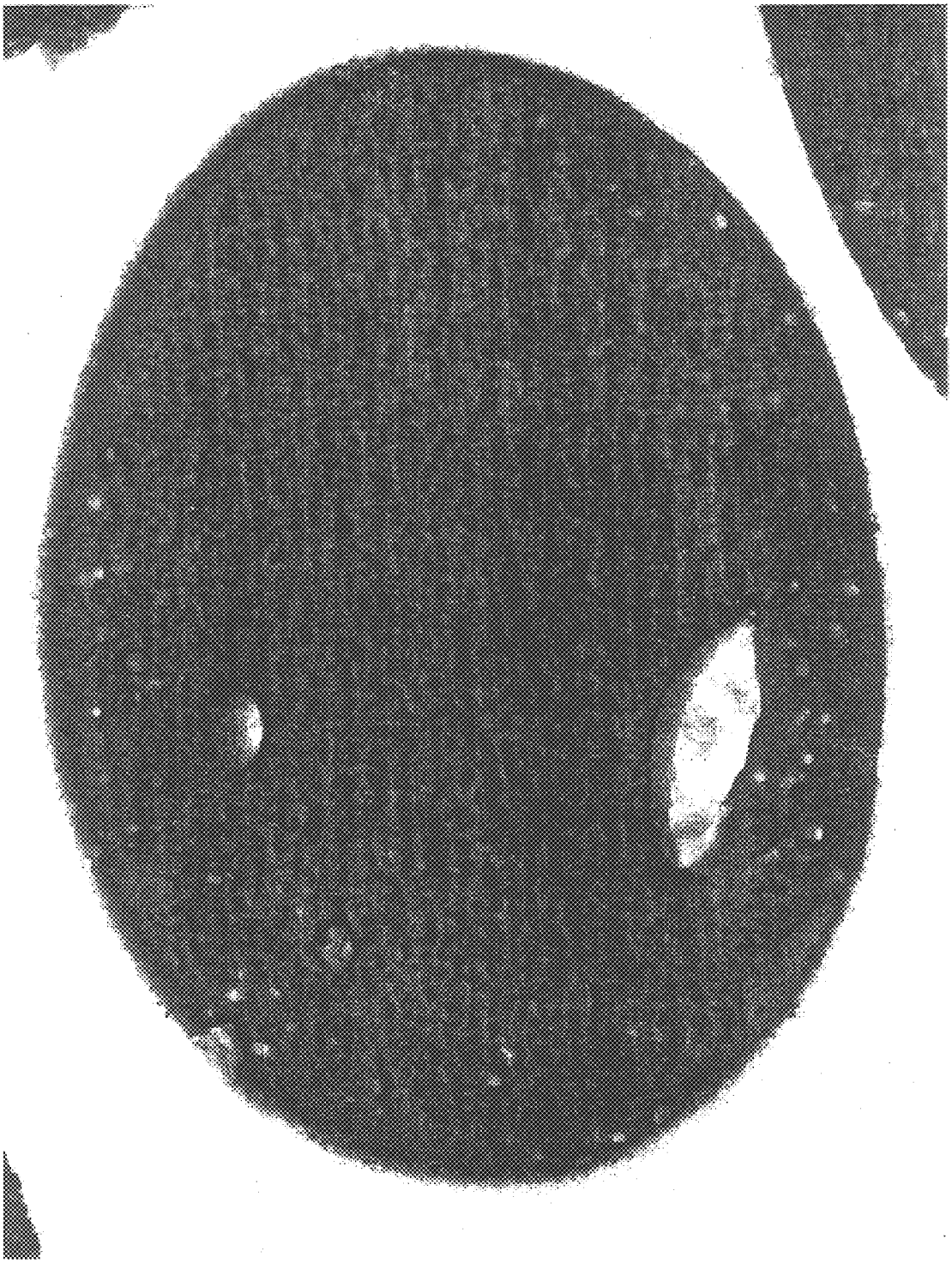

In the dry toners for electro photography according to the present invention, the color resin particle comprises a binder resin, a releasing agent, a coloring agent, a charge control agent, etc. For the binder resin, it is possible to make use of binder materials which are known so far for toners and capable of fixing toners. Preferably but not exclusively, the hinder resins used herein include styrene resins or homopolymers or copolymers containing styrene or substituted styrene such as polystyrene, poly-amethylstyrene, chloropolystyrene, styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylate copolymers, styrene-methacrylate copolymers, styrene-acrylate-methacrylate copolymers, styrene-α-methyl chloroacrylate copolymers and styrene-acrylonitrile-acrylate copolymers, polyester resins, epoxy resins, urethane-modified epoxy resins, silicone-modified epoxy resins, vinyl chloride resins, rosin-modified maleic acid resins, phenyl resins, polyethylene, polypropylene, ionomer resins, polyurethane resins, silicone resins, ketone resins, ethylene-ethyl acrylate copolymers, xylene resins, polyvinyl butyral resins, terpene resins, phenol resins, and aliphatic or alicyclic hydrocarbon resins, which may be used singly or in admixture. For the present invention, it is especially preferable to make use of the styrene-acrylic ester resin, styrene-methacrylic ester resin and polyester resin.

The binder resin used has a glass transition temperature of 50° C. to 75° C. and a flow softening point of 100° C. to 150° C. To prepare a low-temperature fixable toner, it is preferable to use a binder resin having a glass transition temperature of 50° C. to 65° C. and a flow softening point of 100° C. to 120° C., and to prepare an oilless fixing toner, it is preferable to use a binder resin having a melt viscosity of $1\times10^3$ to $1\times10^7$ Pa·s at a 50% flow point in view of the agglomeration of the binder resin upon thermal fusion.

For the coloring agent, various organic or inorganic pigments and dyes of various colors may be used as referred to below. Exemplary black pigments are carbon black, copper oxide, triiron tetraoxide, manganese dioxide, Aniline Black, and activated carbon. Exemplary yellow pigments are chrome yellow, zinc yellow, cadmium yellow, yellow iron oxide, Mineral Fast Yellow, nickel titanium yellow, Naval Yellow, Naphthol Yellow S, Hansa Yellow G, Hansa Yellow 10G, Benzidine Yellow G, Benzidine Yellow GR, Quinoline Yellow Lake, Parmanent Yellow NCG and Tartrazine Lake. Exemplary orange pigments are red chrome yellow, molybdenum orange, Permanent Orange GTR, Pyrazolone Orange, Vulcan Orange, Indanthrene Brilliant Orange RK, Benzidine Orange G and Indanthrene Brilliant Orange GKM. Exemplary red pigments are red iron oxide, cadmium red, red lead, mercury sulfide, cadmium, Permanent Red 4R, Lithol Red, Pyrazolone Red, watchung Red, calcium salt, Lake Red D, Brilliant Carmine 6B, eosine lake, Rhodamine Lake B, Alizarine Lake and Brilliant Carmine 3B. Exemplary violet pigments are manganese violet, Fast Violet B and Methyl Violet Lake. Exemplary blue pigments are Prussian blue, cobalt blue, alkali blue lake, Victoria Blue Lake, Phthalocyanine Blue, metal-free Phthalocyanine Blue, a partially chlorinated pigment of Phthalocyanine Blue, Fast Sky Blue and Indanthrene Blue BG. Exemplary green pigments are chrome green, chromium oxide, Pigment Green B, Malachite Green Lake and Final Yellow Green G. Exemplary white pigments are zinc white, titanium oxide, antimony white and zinc sulfide. Exemplary extender pigments are barite powders, barium carbonate, clay, silica, white carbon, talc and alumina white. Various dyes such as basic, acidic, disperse and direct dyes, for instance, include Nigrosine, Methylene Blue, Rose Bengale, Quinoline Yellow and Ultramarine Blue.

These coloring agents may be used alone or in combination of two or more. In either case, however, it is preferable to use the coloring agents in an amount of 1 to 20 parts by weight, and especially 2 to 10 parts by weight per 100 parts by weight of binder resin. At more than 20 parts by weight, the fixability of the toner decreases whereas at less than 1 part by weight, no desired image density is obtainable.

For coloring agents used with a light-transmitting color toner, various pigments and dyes of various colors may be used as recounted below. Exemplary yellow pigments are C. I. 10316 (Naphthol Yellow S), C. I. 11710 (Hansa Yellow 10G), C. I. 11660 (Hansa Yellow 5G), C. I. 11670 (Hansa Yellow 3G), C. I. 11680 (Hansa Yellow G), C. I. 11730 (Hansa Yellow GR), C. I. 11735 (Hansa Yellow A), C. I. 11740 (Hansa Yellow NR), C. I. 12710 (Hansa Yellow R), C. I. 12720 (Pigment Yellow L), C. I. 21090 (Benzidine Yellow), C. I. 21095 (Benzidine Yellow G), C. I. 21100 (Benzidine Yellow GR), C. I. 20040 (Permanent Yellow NCG), C. I. 21220 (Vulcan Fast Yellow 5) and C. I. 21135 (Vulcan Fast Yellow R). Exemplary red pigments are C. I. 12055 (Sterling I), C. I. 12075 (Permanent Orange), C. I. 12175 (Lithol Fast Orange 3GL), C. I. 12305 (Permanent Orange GTR), C. I. 11725 (Hansa Yellow 3R), C. I. 21165 (Vulcan Fast Orange GG), C. I. 21110 (Benzidine Orange G), C. I. 12120 (Permanent Red 4R), C. I. 1270 (Para Red), C. I. 12085 (Fire Red), C. I. 12315 (Brilliant Fast Scarlet), C. I. 12310 (Permanent Red F2R), C. I. 12335 (Permanent Red F4R), C. I. 12440 (Permanent Red FRL), C. I. 12460 (Permanent Red FRLL), C. I. 12420 (Permanent Red F4RH), C. I. 12450 (Light Fast Red Toner B), C. I. 12490 (Permanent Carmine FB) and C. I. 15850 (Brilliant Carmine 6B). Exemplary blue pigments are C. I. 74100 (metal-free Phthalocyanine Blue), C. I. 74160 (Phthalocyanine Blue) and C. I. 74180 (Fast Sky Blue).

These coloring agents may be used singly or in combination of two or more. However, the coloring agent(s) should preferably be used in an amount of 15 to 5 parts by weight, and especially 6 to 12 parts by weight per 100 parts by weight of binder resin. At greater than 15 parts by weight the fixability and transparency of the toner become low whereas at less than 5 parts by weight any desired image density may not be obtained.

Exemplary releasing agents to be dispersed in the colored resin particle are paraffin wax, polyolefin wax, modified wax having an aromatic group, hydrocarbon compounds having an alicyclic group, natural wax, long-chain carboxylic acids having a hydrocarbon long chain with at least 12 carbon atoms [an aliphatic carbon chain of $CH_3(CH_2)_{11}$ or $CH_3(CH_2)_{12}$ or greater] or their esters, metal salts of fatty acids, fatty acid amides and fatty acid bisamides. Mixtures of different low-softening-point compounds may also be used to this end. To be more specific, use may be made of Paraffin Wax (Nippon Oil Co., Ltd.), Paraffin Wax (Nippon Seiro Co., Ltd.), Micro Wax (Nippon Oil Co., Ltd.), Microcrystalline Wax (Nippon Seiro Co., Ltd.), Hard Paraffin Wax (Nippon Seiro Co., Ltd.), PE-130 (Hoechst Co., Ltd.), Mitsui High Wax 110P (Mitsui Petrochemical Industries, Ltd.), Mitsui High Wax 220P (Mitsui Petrochemical Industries, Ltd.), Mitsui High Wax 660P (Mitsui Petrochemical Industries, Ltd.), Mitsui High Wax 210P (Mitsui Petrochemical Industries, Ltd.), Mitsui High Wax 320P (Mitsui Petrochemical Industries, Ltd.), Mitsui High Wax 410P (Mitsui Petrochemical Industries, Ltd.), Mitsui High Wax 420P (Mitsui Petrochemical Industries, Ltd.), Modified Wax JC-1141 (Mitsui Petrochemical Industries, Ltd.), Modified Wax JC-2130 (Mitsui Petrochemical Industries, Ltd.), Modified Wax Jc-4020 (Mitsui Petrochemical Industries, Ltd.), Modified Wax JC-1142 (Mitsui Petrochemical Industries, Ltd.), Modified Wax JC-5020 (Mitsui Petrochemical Industries, Ltd.), beeswax, carnauba wax and montan wax. Exemplary metal salts of fatty acids are zinc stearate, calcium stearate, magnesium stearate, zinc oleate, zinc palpitate and magnesium palmitate.

For the polyolefinic waxes in particular, for instance, use may be made of low-molecular-weight polypropylene, low-molecular-weight polyethylene, oxidized polypropylene and oxidized polyethylene. To be more specific, use may be made of non-oxidized polyethylene waxes such as Hoechst Wax PE520, Hoechst Wax PE130 and Hoechst Wax PE190, all made by Hoechst Co., Ltd., Mitsui High Wax 200, Mitsui High Wax 210, Mitsui High Wax 210M, Mitsui High Wax 220 and Mitsui High Wax 220M, all made by Mitsui Petrochemical Industries, Ltd., Sun Wax 131-P, Sun Wax 151-P and Sun Wax 161-P, all made by Sanyo Chemical Industries, Ltd.), oxidized polyethylene waxes such as Hoechst Wax PED121, Hoechst Wax PED153, Hoechst Wax PED521, Hoechst Wax PED522, Hoechst Wax Ceridust 3620, Hoechst Wax Ceridust VP130, Hoechst Wax Ceridust VP5905, Hoechst Wax Ceridust VP9615A and Hoechst Wax Ceridust TM9610F and Hoechst Wax Ceridust 3715, all made by Hoechst Co., Ltd., Mitsui High Wax 420M made by Mitsui Petrochemical Industries, Ltd., and Sun Wax E-300 and Sun Wax 250P, all made by Sanyo Chemical Industries, Ltd., non-oxidized polypropylene waxes such as Hoechst Wachs PP230 made by Hoechst Co, Ltd., Biscol 330-P, Biscol 550-P and Biscol 660P, all made by Sanyo Chemical Industries, Ltd., and oxidized polypropylene waxes such as Biscol TS-200 made by Sanyo Chemical Industries, Ltd.

These releasing agents may be used alone or in combination of two or more. The releasing agent should be used in an amount of 0.5 parts by weight to 10 parts by weight, preferably 2 parts by weight to 8 parts by weight, and more preferably 3 parts by weight to 7 parts by weight per 100 parts by weight of binder resin. When the amount of the releasing agent added to the binder resin is too large, a problem arises in conjunction with transparency and contamination due to filming of process members such as photosensitive materials and developers. It is noted that the content of the releasing agent in the colored resin particles is 0.5 parts by weight to 8 parts by weight, preferably 2 parts by weight to 6 parts by weight, and more preferably 3 parts by weight to 5 parts by weight per 100 parts by weight of colored resin particles.

The releasing agent used should preferably be non-compatible with the binder resin. To this end it is preferable to use a releasing agent having a large solubility parameter (SP value) difference of, for instance, at least 0.5 with respect to the binder resin. For instance, when polyester having an SP value of 10.3 is used as the binder resin, it is preferable to use polyethylene wax having an SP value of 7.9 or polypropylene wax having an SP value of 7.8 to 8.0 as the releasing agent.

The releasing agent used herein should also preferably have a softening point (melting point) of 40° C. to 130° C. and especially 50° C. to 120° C. as defined by an endothermic main peak value on a DSC endothermic curve measured by DSC120 made by Seiko Electronics Co., Ltd. A releasing agent having a softening point lower than 40° C. is insufficient for the blocking resistance and shape retention of the toner, and a releasing agent having a softening point exceeding 130° C. is less effective for making the fixation temperature or pressure low. In this connection, it is preferable that the difference between the softening point (melting point) of the releasing agent and the flow softening point of the binder resin is within 30° C.

For the charge control agent, any desired organic or inorganic charge control agents may be used with the proviso that they can give positive or negative charges by tribo-electrification.

Exemplary positive charge control agents are Nigrosine Base EX (made by Orient Chemical Industries, Ltd.), Quaternary Ammonium Salt P-51 (made by Orient Chemical Industries, Ltd.), BONTRON N-01 (made by Orient Chemical Industries, Ltd.), Sudan Chief Schwalts BB (Solvent Black 3: Color Index 26150), Fet Schwalts HBN (C. I. No. 26150), Brilliant Spilit Schwalts TN (Farben Fabricken Bayer K. K.), Pomelo Schwalts (Farberk Hoechst Co., Ltd.), alkoxylated amine, alkylamide, and molybdic acid chelate pigments. Among others, preference is given to Quaternary Ammonium Salt P-51.

Exemplary negative charge agents are Oil Black (Color Index 26150), Oil Black BY (made by Orient Chemical Industries, Ltd.), BONTRON S-22 (made by Orient Chemical Industries, Ltd.), Salicylic Acid Metal Chelate E-81 (made by Orient Chemical Industries, Ltd.), thioindigo pigments, sulfonylamine derivatives of copper phthalocyanine, Spiron Black TRH (Hodogaya Chemical Industries, Ltd.), BONTRON S-34 (made by Orient Chemical Industries, Ltd.), Nigrosine SO (made by Orient Chemical Industries, Ltd.), Ceres Schwalts (R)G (Farben Fabricken Bayer K. K.), Chromogene Schwalts ET00 (C. I. No. 14645), and Azo Oil Black (R) (made by National Aniline Co., Ltd., among which preference is given to Salicylic Acid Metal Chelate E-81.

These charge control agents may be used alone or in combination of two or more. However, the amount of the charge control agent added to the binder resin should be 0.001 part by weight to 5 parts by weight and preferably 0.001 part by weight to 3 parts by weight per 100 parts by weight of binder resin.

In addition, suitable additives such as magnetic particles and dispersing agents may be added to the colored resin particles.

The first dry toner for electrophotography according to the present invention is now explained.

The first dry toner for electrophotography comprises colored resin particles with releasing agent particles dispersed in the binder resin, wherein the releasing agent particles dispersed in each colored resin particle have a particle diameter distribution such that the particle diameter of releasing agent particles dispersed in the vicinity of the surface of each colored resin particle is larger than the particle diameter of releasing agent particles at a central site of the colored resin particle.

Referring to the dispersion of the releasing agent particles in the colored resin particle, an electron scanning microscope photograph indicates that a number of releasing agent particles are scattered in a layer in the vicinity of the surface of the colored resin particle and the releasing agent particles at the central site of the colored resin particle are so closely packed that they cannot be identified. This will be explained in Example 1 with reference to FIG. 1.

In the dry toner for electrophotography according to the present invention, the colored resin particles have an average particle diameter of 3 $\mu$m to 10 $\mu$m and preferably 5 $\mu$m to 8 $\mu$m, whereby high definition is achievable. The colored resin particles have a circularity of 0.93 to 0.99 and preferably 0.94 to 0.98 for the purpose of making improvements in fluidity, cleaning capability and transferability. Depending on the heat-treatment conditions in the hot-air stream, the releasing agent particles dispersed in the vicinity of the surface of each colored resin particle may be allowed to have a particle diameter of up to about 1.5 $\mu$m by their rearrangement. However, the releasing agent particles should preferably have a particle diameter of 0.05 $\mu$m to 0.3 $\mu$m through their rearrangement, and the layer wherein releasing agent particles of large diameter are present should preferably have a thickness of 0.5 $\mu$m to 1.5 $\mu$m although varying with the particle diameter of releasing agent particles, so that the influence of the toner on transparency can be reduced. It is understood that the particle diameter of the releasing agent particles dispersed at the central site of each colored resin particle is considered as being unaffected by the heat-treatment according to the present invention, and hence as being of the order of a few tens of nm.

In the present invention, it is acceptable to extraneously add a fluidity improver to the dry toner for electrophotography so as to enhance its fluidity. For the fluidity improver organic or inorganic fine powders may be used. For instance, use may be made of fine powders of fluorocarbon resins such as vinylidene fluoride, polytetrafluoroethylene and acrylic resins; fine powders of metal salts of fatty acids such as zinc strearate, calcium stearate and lead stearate; fine powders of metal oxides such as iron oxide, aluminum oxide, titanium oxide and zinc oxide; and fine powders of silica such as wet-process silica and dry-process silica which may have been surface treated with a silane coupling agent, a titanium coupling agent, silicone oil or the like. These improvers may be used singly or in admixture.

A preferable fluidity improver is a fine powder obtained by the vapor-phase oxidization of a silicone halide compound, i.e., an improver usually referred to as the so-called pyrogenic silica or fumed silica produced by conventional processes. For instance, this makes use of the pyrolytic oxidization reaction of a silicon tetrachloride gas in oxygen hydrogen flames on the basis of the following reaction scheme:

$$SiCl_4+2H_2+O_2 \rightarrow SiO_2+4HCl$$

If, in this production process, other metal halide compound such as aluminum chloride or titanium chloride is used along with the silicon halide compound, it is then possible to obtain a composite fine powder comprising silica and other metal oxide. This composite fine powder, too, is included in the preferable fluidity improver. The preferable fine powders should preferably have a mean primary particle diameter of 0.001 μm to 2 μm. Particular preference is given to the use of fine silica powders in the range of 0.002 μm to 0.2 μm in the mean primary particle diameter.

Commercially available fine silica powder products used herein and produced by the vapor-phase oxidization of silicon halide compounds are obtained under the following trade names of AEROSIL 130, 200, 300, 280, TT600, MOX170, MOX80, COK84, etc., all made by Nippon Aerosil Co., Ltd.; Ca-O-SiL M-5, MS-7, MS-75, HS-5, EH-5, etc., all made by CABOT Co., Ltd.; Wacker HDK N20V15, N20E, T30, T40, etc., all made by WACKER-CHEMIE GMBH,; D-C Fine Silica made by Dow Corning Co., Ltd.; and Fransol made by Fransil Co., Ltd.

It is more preferable to use fine powders of silica obtained by the vapor-phase oxidization of the silicon halide compound and then subjected to a hydrophobic treatment. Most preferably in this case, the fine powders of silica should have been subjected to the hydrophobic treatment in such a way that the degree of hydrophobicity is in the range of 30 to 80 as measured by methanol titration testing. The hydrophobic treatment may be carried out by chemically treating the fine powders of silica with an organic silicon compound capable of reacting with or being physically adsorbed onto the fine powders. Preferably in this case, the fine powders of silica obtained by the aforesaid vapor-phase oxidization of the silicon halide compound is treated with an organic silicon compound.

Examples of such an organic silicon compound are hexamethylenedisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, ρ-chloroethyltrichlorosilane, chloromethyldimethylchlorosilane, triorganocsilylmercaptan, trimethylsilylmercaptan, triorganosilyl acrylate, vinyldimetylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and a hydroxyl group attached to one Si for each terminated unit. These organic compounds may be used alone or in combination of two or more.

The thus treated fine powders of silica should preferably have a particle diameter of 0.003 μm to 0.1 μm and especially 0.005 μm to 0.05 μm. The fine powders of silica used herein are commercially available under the trade names of Taranox 500 (Tarco Co., Ltd.), and AEROSIL R-972 (Nippon Aerosil Co, Ltd.).

The amount of the fluidity improver added should be 0.01 part by weight to 5 parts by weight and preferably 0.1 part by weight to 3 parts by weight per 100 parts by weight of the aforesaid resin particles. At less than 0.01 part by weight there is no effect on fluidity improvements whereas at greater than 5 parts by weight the fluidity improver scatters in the production system, resulting in fogging and character blurring.

The production process for the first dry toner for electrophotography according to the present invention is made up of the following steps.

(1) Step of Uniform Mixing of the Raw Feed

Given amounts of the binder resin, the releasing agent, the coloring agent and addtives such as charge control agents are charged in Henschel Mixer 20B (Mitsui Mining Co., Ltd.) for uniform mixing. In this case, it is acceptable to prepare a master batch comprising the binder resin and coloring agent so that the master batch can be uniformly mixed with a diluting binder resin and additives such as charge control agents. The proportion of the binder resin and coloring agent in the master batch is binder resin:coloring agent=90:10 to 50:50 (parts by weight), and preferably 80:20 to 60:40 (parts by weight). Referring here to exemplary proportions for toner particle preparation, per 100 parts by weight of binder resin, the master batch coloring agent is used in an amount of 20 to 60 parts by weight and preferably 30 to 50 parts by weight, the releasing agent in an amount of 0.5 to 10 parts by weight and preferably 2 to 8 parts by weight, the charge control agent in an amount of 5 parts by weight or less and preferably 3 parts by weight or less, and other intraneously added additives such as dispersants in a suitable amount.

(2) Step of Dispersing and Fixing Each Additive in the Binder Resin

After completion of uniform mixing, the mixture is hot kneaded together using a double-shaft kneading extruder (PCM-30 made by Ikegai Chemical Industries, Ltd.), so that each additive is dispersed and fixed in the binder resin. Hot kneading may also be carried out using continuous kneaders such as TEM-37 (Toshiba Machine Industry Co., Ltd.) and KRC Kneader (Kurimoto Ironworks Co., Ltd.), and batch kneaders such as heat-and-pressure kneaders.

(3) Grinding Step

The kneaded product is crushed for particle diameter regulation. Then, the crushed product is finely ground into a mean particle diameter of 1 to 8 μm by air jet impact milling using Jet Mill 200AFG (Hosokawa Micron Co., Ltd.) or IDS-2 (made by Nippon Pneumatic Industries, Ltd.). This fine grinding may also be carried out by means of a mechanical grinding machine Turbomill (made by Kawasaki Heavy Industries, Ltd.), Super Rotor (Nisshin Engineering Co., Ltd.), etc.

(4) Classification Step

Following removal of extra fine powders, particle diameter regulation by pneumatic force or the rotation of a rotor is carried out for the purpose of making particle diameter distribution sharp, using a pneumatic classifier 100ATP (made by Hosokawa Micron Co., Ltd.), DSX-2 (made by Nippon Pneumatic Industries co., Ltd.), Elbow Jet (made by Nittetsu Mining Co., Ltd.), etc. The colored resin particles obtained in this classification step have a circularity of 0.70 to 0.92.

(5) Step of Re-dispersion of the Releasing Agent Particles in the Colored Resin Particles For the rearrangement of the particle diameter of releasing agent particles in the vicinity of the surface of each colored resin particle, the classified product is heat treated using a hot-air spheronizer "Surfusing System SFS-3 Type (made by Nippon Pneumatic Industries Co., Ltd.) under the following running conditions. The temperature of hot air at the inlet is 250 to 350° C., the flow rate of hot air is 0.6 to 1.5 $m^3$/min. per unit area (with the sectional area of hor air being $1.26\times10^{-3}m^2$, the length of a heat treating zone being about 0.4 m, and the flow rate of hot air per unit area being 1.0 $m^3$/min. corresponding to the flow velocity of 15 m/sec. of hot air), the input of the raw feed is 0.5 to 1.4 kg/hr. per unit area, and the time of contact of the raw feed with hot air is 0.01 to 1.0 sec. This give particles having a circularity of 0.93 to 0.99.

By the hot-air spheronizer treatment of the classified colored resin particle having pits and projections under such controlled conditions, it is believed that at the projections the binder resin is fused together with the dispersed releasing agent particles so that the colored resin particle is spherically shaped due to the cohesive force of the binder resin, with an increasing diameter due to the agglomeration of the releasing agent particles. It is also believed that at the central site of the coloring agent particle the diameter of the releasing agent particles remain unchanged.

(6) Extraneous Addition of Additives

Given amounts of the obtained colored resin particles and a fluidizing agent are charged in Henschel Mixer 20B (made by Mitsui Mining Co., Ltd.) for uniform mixing, thereby obtaining the first dry toner for electrophotography according to the present invention.

In and on the colored resin particle, the releasing agent is non-compatible with the binder resin, and the difference between the softening point (melting point) of the releasing agent and the flow softening point of the binder resin is kept within the predetermined constant range, as mentioned above. Consequently, the projections of the colored resin particle are fused under the heat treating conditions in the hot-air stream to cause the rearrangement of the releasing agent particle diameter, so that the releasing agent particles can be re-dispersed, with an increasing diameter, in an internal layer in the vicinity of the surface of the colored resin particle and, hence, the state of dispersion where preferable releasability is ensured on a fixing roller is achievable. In the colored resin particle, the particle diameter of the releasing agent particles remains very small, so that the transparency of the toner particles is ensured. With the present invention it is thus possible to ensure offset resistance and transparency even when the releasing agent is not used in large amounts.

More specifically, the releasing agent particles remain dispersed in the color resin particle, so that they are less likely to contaminate process members such as developing rollers and photosensitive materials by filming. Instantaneously upon toner fixation on a heat roller, large-diameter releasing agent particles dispersed in the vicinity of the surface of the colored resin particle are fused out at that surface in a larger amount as compared with the closely packed releasing agent particles. Thus, the releasing agent particles can produce a more enhanced releasing effect on a fixing roller with no increase in the content of the releasing agent. If the releasing agent particles dispersed in the vicinity of the surface of the colored resin particle have a particle diameter of 0.05 $\mu$m to 0.3 $\mu$m with releasing agent particles being closely packed at the central site of the colored resin particle, it is then possible to provide toner particles well fit for a color toner because the releasing agent has little influence on the transparency of the toner particles.

The second electrophotographic dry toner is now explained.

According to the second aspect of the present invention, there is provided an electrophotographic dry toner comprising colored resin particles with releasing agent particles dispersed in a binder resin, wherein the surface of each colored resin particle is provided thereon with a resin coating layer. In this toner, the releasing agent particles dispersed in each colored resin particle have a particle diameter distribution such that the particle diameter of releasing agent particles dispersed in the vicinity of the surface of each colored resin particle is larger than the particle diameter of releasing agent particles at a central site of the colored resin particle.

The resin coating layer may be formed by uniformly fixing the encapsulating resin particles onto the surface of the colored resin particle obtained at the classification step (4) in the aforesaid first electrophotographic dry toner production process by means of mechanical impact or a dry mechanochemical method, followed by a similar treatment in the same hot-air stream as explained in connection with the aforesaid first electrophotographic dry toner. By this hot-air stream treatment, it is possible to fuse the encapsulating resin particles to one another on the colored resin particle to form a coating film thereon and rearrange the particle diameter distribution of the releasing agent particles dispersed in the colored resin particle simultaneously with the application of the resin coating layer, as explained in conjunction with the aforesaid first electrophotographic dry toner.

For the encapsulating resin particles, it is preferable to use spherical particles produced by a soap-free emulsion polymerization method, wherein an emulsifying agent is removed from an emulsion polymerization system, so that as an initiator radical generated in an aqueous phase combines together monomers slightly dissolved in the aqueous phase, an insoluble particle grows into a particle nucleus. Particles produced by this polymerization method can have a sharp particle diameter distribution, with a particle diameter adjusted to the range of 0.1 $\mu$m to 1 $\mu$m. By using particles having a uniform particle diameter as the encapsulating resin particles, it is possible to obtain a uniform coating layer wherein the adhesive forces of individual encapsulating resin particles are less susceptible to variation. A problem with the use of particles having a wide particle diameter distribution is that any uniform coating layer cannot be formed because they are deposited onto the colored resin particle preferentially in decreasing diameter order. The particles obtained by soap-free emulsion polymerization, because of having been formed without recourse to any emulsifying agent (surface active agent), serve as a toner particle surface layer for prevention of moisture influences and so can provide toner particles having improved charge stability. It is also possible to prevent agglomeration of the encapsulating resin particles with one another and generation of a minor amount of free fine powders. The encapsulating resin particles may be prepared with the addition thereto of not only monomers and polymerization initiators but also other desired various additives inclusive of coloring agents, and charge control agents. If charge control agents are incorporated into the encapsulating resin particles, it is then unnecessary to incorporate them into the colored resin particles.

For the monomers used for the preparation of the encapsulating resin particles, vinylic monomers may be used. For instance, use may be made of styrene and their derivatives such as o-methylstyrene, m-methylstyrene, p-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-ethoxystyrene, p-phenylstyrene, p-chlorostyrene and 3,4-dichlorostyrene, among which styrene is most preferred. Other vinylic monomers may also be used, inclusive of ethylene unsaturated monoolefins such as ethylene, propylene, butylene and isobutylene; halogenated vinyls such as vinyl chloride, vinylidene chloride, vinyl bromide and vinyl fluoride; vinyl esters such as vinyl acetate, vinyl propionate, vinyl benzoate and vinyl butylate; a-methylene aliphatic monocarboxylic esters such as methyl acrylate, ethyl acrylate, n-butyl acrylate, isobutyl acrylate, propyl acrylate, n-octyl acrylate, docecyl acrylate, 2-ethylhexyl acrylate, stearyl acrylate, 2-chloroethyl acrylate, phenyl acrylate, α-methyl chloroacrylate, methyl methacrylate, ethyl methacrylate, propyl methacrylate, n-butyl methacrylate, isobutyl methacrylate, propyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; (meth)acrylic acid derivatives such as acrylonitrile and methacrylonitrile acrylamide; vinyl ethers such as vinyl methyl ether, vinyl ethyl ether and vinyl isobutyl ether; vinyl ketones such as vinyl methyl ketone, vinyl hexyl ketone and methyl isopropenyl ketone; N-vinyl compounds such as N-vinylpyrrole, N-vinylcarbazole, N-vinylindole and N-vinylpyrrolidone; and vinyl naphthalenes. These vinylic monomers used as the synthetic resins for the encapsulating resin particles may be used in the form of a homopolymer comprising one such monomer or a copolymer comprising two or more such monomers.

Besides, the vinylic monomer usable herein include monomer components containing a nitrogenous polar functional group, which may be used alone or in combination with the aforesaid monomers. If the encapsulating resin particles are obtained from such monomers having a polar group, it is then possible to impart the desired chargeability to the toner even when the amount of the charge control agent contained in the colored resin particles is reduced, because the encapsulating resin particles themselves have a charge control role.

The nitrogenous polar functional group is effective for positive charge control. The monomers having a nitrogenous polar functional group, for instance, include an amino(meth) acrylate monomer represented by the following general formula:

$$CH_2=C(R_1)\text{-}COX\text{-}Q\text{-}N(R_2)(R_3)$$

where $R_1$ is a hydrogen atom or a methyl group, $R_2$ and $R_3$ are each a hydrogen atom or an alkyl group having 1 to 20 carbon atoms, X is an oxygen or nitrogen atom, and Q is an alkylene or arylene group.

Typical examples of the amino(meth)acrylate are N,N-dimethylaminomethyl (meth)acrylate, N,N-diethylaminomethyl (meth)acrylate, N,N-dimethylamino (meth)acrylate, N,N-diethylaminoethyl (meth)acrylate, N,N-dimethylaminopropyl (meth)acrylate, N,N-dimethylaminobutyl(meth)acrylate, p-N,N-dimethylaminophenyl (meth)acrylate, p-N,N-diethylaminophenyl (meth)acrylate, p-N,N-dipropylaminophenyl (meth)acrylate, p-N,N-dibutylaminophenyl (meth)acrylate, p-N-laurylaminophenyl (meth)acrylate, p-N-stearylaminophenyl (meth)acrylate, p-N,N-dimethylaminobenzyl (meth)acrylate, p-N,N-diethylaminobenzyl (meth)acrylate, p-N,N-dipropylaminobenzyl (meth)acrylate, p-N,N-dibutylaminobenzyl (meth)acrylate, p-N-laurylaminobenzyl (meth)acrylate and p-N-stearylaminobenzyl (meth)acrylate as well as N,N-dimethylaminoethyl(meth)acrylamide, N,N-diethylaminoethyl(meth)acrylamide, N,N-dimethylaminopropyl (meth)acrylamide, N,N-diethylaminopropyl(meth)acrylamide, p-N,N-dimethylaminophenyl(meth)acrylamide, p-N,N-diethylaminophenyl(meth)acrylamide, p-N,N-dipropylaminophenyl (meth)acrylate, p-N,N-dibutylaminophenyl (meth)acrylamide, p-N-laurylaminophenyl(meth)acrylamide, p-N-stearylaminophenyl (meth)acrylamide, p-N,N-dimethylaminobenzyl (meth)acrylamide, p-N,N-diethylaminobenzyl(meth)acrylamide, p-N,N-dipropylaminobenzyl(meth)acrylamide, p-N,N-dibutylaminobenzyl (meth)acrylamide, p-N-laurylaminobenzyl (meth)acrylamide and p-N-stearylamiobenzyl(meth)acrylamide.

The fluorine atom is effective for negative charge control. Preferably but not exclusively, fluoroalkyl (meth)acrylates such as 2,2,2-trifluoroethyl acrylate, 2,2,3,3-tetrafluoropropyl acrylate, 2,2,3,3,4,4,5,5-octafluoroamyl acrylate and 1H,1H,2H,2H-heptadecafluorodecyl acrylate are used as the fluorine-containing monomer. use may also be made of trifluoroethylene, vinylidene fluoride, ethylene trifluoride, ethylene tetrafluoride, trifluoropropylene, hexafluoropropen, hexafluoropropylene, etc. The synthetic resin used for the encapsulating resin particles may be used in the form of a homopolymer comprising one such monomer or a copolymer comprising two or more such monomers.

The encapsulating resin particles are spherical particles obtained by soap-free emulsion polymerization and having an average particle diameter of 0.05 μm to 1 μm, preferably 0.1 to 0.8 μm, and more preferably 0.15 μm to 0.4 μm. With encapsulating resin particles having a mean particle diameter less than 0.05 μm, their own object cannot be fully accomplished, because the encapsulating resin particle layer should have a small thickness for the purpose of imparting heat resistance to the toner. Encapsulating resin particles, when they have an average particle diameter greater than 1 μm, have difficulty in their uniform deposition to the surface of the colored resin particle, resulting in a surface coverage drop and, hence, no sufficient improvements in toner clea ability, heat resistance, etc. When such particles are used for the purpose of imparting heat resistance to the toner, they are likely to be affected by the colored resin particles. Further, large encapsulating resin particles have difficulty in their firm fixation to the surface of the colored resin particle. The encapsulating resin particle should preferably have an average particle diameter that is ⅕ or less of the average particle diameter of the colored resin particle.

For the encapsulating resin particles, it is preferable to use a resin similar in chemical structure to the binder resin for the colored resin particles. That resin should preferably have a glass transition temperature (Tg) of 50° C. to 100° C., especially 60° C. to 90° C., and a flow softening point of 70° C. to 200° C., especially 100° C. to 170° C.

The encapsulating resin particles should preferably have a flow softening point that is at least 5° C., especially 20° C. to 40° C. higher than that of the binder resin for the colored resin particles.

The encapsulating resin particles should be used in an amount of 5 to 25 parts by weight, and preferably 10 to 20 parts by weight per 100 parts by weight the colored resin particles to provide a resin coating layer having a thickness of 0.05 μm to 1 μm, preferably 0.1 μm to 0.6 μm, and more preferably 0.15 to 0.35 μm. It is thus possible to obtain a toner that can be free from filming to process members such as photosensitive materials, developers, etc., and is improved in terms of transparency and storability.

Upon fixation, the fused releasing agent comes out of the colored resin particle instantaneously with the disintegration of the resin coating layer by a beat fixing roller, so that the release of the toner from the heat fixing roller can be much more ensured. In addition, the dry toner for electrophotography according to the present invention is allowed to have transparency due to the reduced amount of the releasing agent, and is improved in terms of offset resistance without recourse to any increased amount of the releasing agent.

The thus obtained inventive second dry toner for electrophotography has an average particle diameter of 3 μm to 10

μm, preferably 5 μm to 8 μm, thereby ensuring high-definition images, and a circularity of 0.93 to 0.99, preferably 0.94 to 0.98 thereby improving its fluidity and cleanabililty.

The production process for the second dry toner for electrophotography according to the present invention is made up of the following steps.

The second dry toner for electrophotography is produced by preparing classified colored resin particles as in the steps (1) to (4) for the first electrophotographic dry toner and then carrying out the following steps (5) to (7).

(5) Step of Deposition of the Resin Particles onto the Surface of the Colored Resin Particle A given amount of encapsulating resin particles are uniformly fixed onto the surface of the colored resin particles by means of mechanical impact or a dry mechanochemical method. The mechanical impact is obtained through the shear force of a rotor and a stator, the collision of particles with one another and with the wall of the apparatus used in a high-speed air stream. To this end, for instance, Hybridizer NHS-1 (Nara Kikai Seisakusho Co., Ltd.), and Cosmosystem (Kawasaki Heavy Industries, Ltd.) may be used. The dry mechanochemical method makes use of heat generated by the friction and compression under shear force of particles with one another or with the wall member of the apparatus used, thereby fixing the encapsulating resin particles onto the surface of the colored resin particles. To this end, for instance, Mechanofusion System (Hosokawa Micron Co., Ltd.), and Mechanomill (Okada Seikosha Co., Ltd.) may be used.

(6) Step of Re-dispersion of the Releasing Agent Particles in the Colored Resin Particle with the Encapsulating Resin Particles Deposited onto It For the rearrangement of particle diameter whereby the encapsulating resin particles deposited to the colored resin particle are fused to one another to form a resin coating layer and the particle diameter of the releasing agent particles dispersed in the vicinity of the surface of the U.S. application Ser. No. 09/959,952 Art Unit 1756 colored resin particle is increased, the particles are heat treated using the hot-air spheronizer "Surfusing System SFS-3 Type (made by Nippon Pneumatic Industries Co., Ltd.) under the following running conditions. As specified in conjunction with the first dry toner for electrophotography, the temperature of hot air at the inlet is 250 to 350° C., the flow rate of hot air is 0.6 to 1.5 $m^3$/min. per unit area (with the sectional area of the hot-air being $1.26\times10^{-3}m^2$, the length of heat treating zone being about 0.4 m, and the flow rate of the hot-air per unit area being 1.0 $m^3$/min. corresponding to the flow velocity of 15 in/sec. of the hot-air), the input of the raw feed is 0.5 to 1.4 kg/hr. per unit area, and the time of contact of the raw feed with hot air is 0.01 to 1.0 sec.

The classified colored resin particle with the encapsulating resin particles deposited thereto is subjected to the hot-air "spheronizer" treatment or shaped into a sphere to provide a toner particle having a circularity of 0.93 to 0.99. Under the appropriately selected conditions for the hot-air "spheronizer" treatment, it is believed that the encapsulating resin particles are fused to one another on the surface of the colored resin particle to form a resin coating layer thereon, and the classified colored resin particle having pits and projections is shaped by the cohesive force of the binder resin into a sphere with an increasing diameter due to the agglomeration of the releasing agent particles, because at the projections the binder resin is fused together with the dispersed releasing agent particles. It is also believed that the diameter of the releasing agent particles at the central site of the colored resin particle remains unchanged.

(7) Extraneous Addition Treatment

Given amounts of the obtained colored resin particles having resin coating layers thereon and a fluidizing agent are charged in Henschel Mixer 20B (made by Mitsui Mining Co., Ltd.) for uniform mixing, thereby obtaining the second dry toner for electrophotography according to the present invention.

The third dry toner for electrophotography and its production process are now explained.

The third dry toner for electrophotography according to the present invention is an electrophotographic dry toner comprising colored resin particles with releasing agent particles dispersed in a binder resin and encapsulating resin particles fixedly fused to the surface of each colored resin particle to form a resin coating layer thereon, wherein said colored resin particle is coated with said resin coating layer with a releasing agent layer interposed therebetween.

The third dry toner for electrophotography according to the present invention is produced as is the case with the aforesaid second electrophotographic dry toner production process with the exception that the heat treatment conditions are modified or varied. This electrophotographic dry toner is different from the second dry toner for electrophotography in terms of what state the releasing agent is present in. In other words, each colored resin particle is coated with said resin coating layer with the releasing agent is interleaved between them. The resin coating layer has a thickness of 0.05 μm to 1 μm while the releasing agent layer has a thickness of 0.001 μm to 0.01 μm and preferably 0.004 μm to 0.008 μm.

The process for the production of the third dry toner for electrophotograhy according to the present invention comprises the same steps (1) to (5) and (7) as in the process for the production of the second electrophotographic dry toner and the following step (6).

(6) Step of Forming the Resin Coating Layer and Releasing Agent Layer by Fixation and Fusion of the Encapsulating Resin Particles To fix and fuse the encapsulating resin particles deposited to the colored resin particle to one another to form a resin coating layer and form a releasing agent layer between the colored resin particle and the resin coating layer, the particles are heat treated using the hot-air spheronizer "Surfusing System SFS-3 Type (made by Nippon Pneumatic Industries Co., Ltd.) under the following running conditions. As specified in conjunction with the second dry toner for electrophotography , the temperature of the hot-air at the inlet is 250 to 350° C., the flow rate of the hot-air is 0.6 to 1.5 $m^3$/min. per unit area (with the sectional area of the hot-air being $1.26\times10^{-3}m^2$, the length of a heat treating zone being about 0.4 m, and the flow rate of the hot-air per unit area being 1.0 $m^3$/min. corresponding to the flow velocity of 15 m/sec. of the hot-air), the input of the raw feed is 0.5 to 1.4 kg/hr. per unit area, and the time of contact of the raw feed with the hot-air is 0.01 to 1.0 sec.

The classified colored resin particle with the encapsulating resin particles deposited thereto is subjected to the hot-air "spheronizer" treatment or shaped into a sphere to provide a toner particle having a circularity of 0.93 to 0.99. Under the appropriately selected conditions for the hot-air "spheronizer" treatment, it is possible to fuse the encapsulating particles to one another to form the resin covering layer on the surface of the colored resin particles and form the releasing agent layer between the colored resin particle and the resin coating layer.

In and on the colored resin particle of the third electrophotographic dry toner according to the present invention, the releasing agent should be non-compatible with the binder resin; there should be a limited difference between the softening temperature of the releasing agent and the flow softening point of the binder resin; and the flow softening temperature of the resin coating layer should be higher than the flow softening temperature of the binder resin. In addition, the heat treatment conditions in the hot-air stream should be properly controlled within the aforesaid conditions. It is thus believed that the binder resin and releasing agent are fused earlier than the encapsulating resin particles deposited to the surface of the colored resin particle, so that as the colored resin particle is shaped into a sphere in association with its thermal deformation, the releasing agent is precipitated on the surface of the colored resin particle to form the releasing agent layer while the encapsulating resin particles are fused to form the resin coating layer.

The third electrophotographic dry toner of the present invention has a triple-layer structure comprising the colored resin particle and the resin coating layer between which the releasing agent layer is interposed, and is especially effective for an energy-saving or low-pressure fixation mode. Further, this dry toner shows improved robustness with no contamination of process members such as photosensitive materials and developers by filming due to the releasing agent, the binder resin having a low softening temperature, etc.

Upon toner fixation on a heat roller, the releasing agent is fused out instantaneously with the disintegration of the resin coating layer, with an amount larger than the releasing agent finely dispersed in the binder resin, so that the releasing effect on the fixing roller can be much more enhanced without any increase in the content of the releasing agent.

The releasing agent particles are also finely dispersed in the colored resin particle. It is thus possible to apply the toner to a variety of recording materials such as thin copying paper because even upon toner fixation with relatively high energy, the inside releasing agent seeps fully out of the colored resin particle and so produces an ever higher releasing effect. If the releasing agent layer has a thickness of 0.001 $\mu$m to 0.01 $\mu$m, it is then possible to use this toner as a color toner because it has little influence on transparency.

The process for the production of the fourth electrophotographic dry toner according to the present invention is now explained. with this process, it is possible to obtain an electrophotographic dry toner that is reduced in the amount of free fine powders, improved in terms of transparency and suitable for use as a color toner.

The process for the production of the fourth electrophotographic dry toner according to the present invention has the same steps, i.e., (1) the step of uniform mixing of the raw feed, (2) the step of dispersion and fixation of the respective additives in the binder resin, (3) the grinding step, (4) the classification step and (7) the extraneous addition step as in the aforesaid third production process with the exception of the following steps (5) and (6).

(5) Step of Formation of the Releasing Agent Layer by Heat Treatment

At this step, the releasing agent layer is first formed on the surface of the colored resin particle obtained through the classification step. To form the releasing agent layer on the surface of the colored resin particle, the particles are heat treated using the hot-air spheronizer "Surfusing System SFS-3 Type (made by Nippon Pneumatic Industries Co., Ltd.) under the following running conditions. As already specified , the temperature of the hot-air at an inlet is 250 to 350° C., the flow rate of hot air is 0.6 to 1.5 $m^3$/min. per unit area (with the sectional area of hot air being $1.26\times10^3 m^2$ and the length of a heat treating zone being about 0.4 m), the input of the raw feed is 0.5 to 1.4 kg/hr. per unit area, and the time of contact of the raw feed with hot air is 0.01 to 1.0 sec. The heat treatment under the aforesaid heat treatment conditions gives a releasing agent layer of 0.001 $\mu$m to 0.01 $\mu$m and preferably 0.002 $\mu$m to 0.005 $\mu$m in thickness on the surface of the colored resin particle. A non-uniform releasing agent layer is not preferable because it is impossible to provide full fixation of encapsulating resin particles at the subsequent encapsulation step, resulting in an increase in the amount of free fine powders.

(6) Encapsulation Step

Then, a given amount of particles obtained by soap-free emulsion polymerization, servinig as encapsulating resin particles, is uniformly fixed onto the surface of the colored resin particles by means of mechanical impact or a dry mechanochemical method. The mechanical impact is obtained through the shear force of a rotor and a stator, the collision of particles with one another and with the wall of the apparatus used in a high-speed air stream. To this end, for instance, Hybridizer NHS-1 (Nara Kikai Seisakusho Co., Ltd.), and Cosmosystem (Kawasaki Heavy Industries, Ltd.) may be used. The dry mechanochemical method makes use of heat generated by the friction and compression under shear force of particles with one another or with the wall member of the apparatus used, thereby fixing the encapsulating resin particles onto the surface of the colored resin particles. To this end, for instance, Mechanofusion System (Hosokawa Micron Co., Ltd.), and Mechanomill (Okada Seikosha Co., Ltd.) may be used.

According to the process for the production of the fourth electrophotographic dry toner, the colored resin particle is heat treated to form the releasing agent layer on its surface, and then encapsulated with the encapsulating resin particles. In the thus obtained toner particle structure, the releasing agent layer is not allowed to exist as distinct a layer as can be found in the third electrophotographic dry toner. With this structure, however, it is possible to incorporate an increased amount of the releasing agent between the colored resin particle and the resin coating layer.

The electrophotographic dry toner obtained by the fourth electrophotographic dry toner production process has functions similar to those of the electrophotographic dry toner having a releasing agent layer, so that any filming problem with photosensitive materials or developers can be prevented and upon toner fixation on a heat roller, the releasing agent can be fused out simultaneously with the disintegration of the resin coating layer. The toner is effective for an energy-saving or low-pressure fixation mode because it shows an even higher releasing effect on the fixation roller with no increase in the amount of the releasing agent incorporated. The toner is also improved in terms of transparency and so is suitable for colorization because the content of the releasing agent in the colored resin particle is reduced.

The electrophotographic dry toner obtained by the fourth electrophotographic dry toner production process is improved in terms of encapsulating resin particle deposition capability over that obtained by the third electrophotographic dry toner production process, so that the amount of free fine powders can be reduced and transparency can be much more improved due to the absence of any distinct releasing agent layer.

It is noted that mere reference to the "particle diameter" in the present disclosure means an "average particle diameter" determined by measuring a relative weight distribution per particle diameter with a 100-$\mu$m aperture tube, using a Coulter counter TA-II type (made by Coulter Counter Co., Ltd.).

The flow softening point of the binder resin or resin coating layer means their temperature at a 50% flow point as measured by a bridge type flow tester CFT-5000 (made by Shimadzu Corporation).

The softening point (melting point) of the releasing agent is here defined by an endothermic main peak value on a DSC endothermic curve found by DSC120 made by Seiko Electronics Co., Ltd.

The circularity used herein is represented by the (circumferential length of a circle having same area as the projection area of a particle)/the (contour length of a particle projected area), and found by measurement at a measuring rate of 1,500 particle per minute, using FPIA-2000 (made by Sysmex Co., Ltd.).

In what follows, the present invention will be explained in further detail with reference to specific examples. In the examples, etc., the obtained electrophotographic dry toners were estimated as to fixability (at a non-offset area in ° C.), transparency (HAZE value) at 150° C., filming onto the surface of a developing roller and the amount of free fine powders in the following manners.

Fixing Test

Using a commercially available laser printer (IBM4019) relying upon a mono-component development mode, unfixed image samples were gathered. The unfixed image samples were passed through a fixing device in a laser printer (KL2010, Konica Co., Ltd.) (using a back side heating mode with a PFA tube fixing roller and a nip passing time of 60 msec.) for fixing test purposess.

Evaluation of Fixability

Non-offset Area

The surface temperature of the fixing roller was varied, the unfixed sample samples were fed, thereby making a visual evaluation of whether or not offsets were found on the samples after fixation.

Evaluation of Transparency

The HAZE value of a fixed image on an OHP sheet was measured, using a HAZE meter (Haze Meter Model 1001DP made by Nippon Denshoku Kogyo co., Ltd.).

Filming

A toner was set in a developing unit in a commercially available laser printer (IBM4019) relying upon a mono-component development mode, and conditioned on a photosensitive material in such a way that it was not developed. Then, only the developing unit was driven to find a point of time where a streak form of fusion (filming) was observed on the surface of a developing roller.

Measurement of the Amount of Free Fine Powders

The amount of free fine powders was measured using a dry particle diameter distribution measuring device "Aerorizer DSP" made by TSI Co., Ltd., U.S.A., and evaluated in terms of how much particles having a particle diameter of 1.8 μm or less were contained in a toner sample (number base percentage).

The first and second electrophotographic dry toners of the present invention and their production processes are now explained with reference to Examples 1 to 4 and Comparative Examples 1 to 3.

EXAMPLE 1

Composition of Coloring Resin Particles

Binder resin: 100 parts by weight

This binder resin was a styrene-butyl acrylate copolymer having a glass transition temperature (Tg) of 56° C., a flow softening point (Tf) of 115° C., a weight-average molecular weight of $5\times10^4$ and a number-average molecular weight of $4\times10^3$.

Coloring master batch: 40 parts by weight

This master batch was a mixture consisting of 70 parts by weight of the aforesaid binder resin and 30 parts by weight of Permanent Red F2R, C. I. 12310.

Negative chargeable charge control agent: 1 part by weight

This charge control agent was an oxo-gluco compound ("Copy Charge NCA cp2243" made by Clariant Co., Ltd.).

Releasing agent: 3 parts by weight

For the releasing agent, a polywax having a melting point of 128° C., i.e., Hoechst Wax PE130 made by Hoechst Co., Ltd. was used.

The aforesaid composition was uniformly mixed together at 2,800 rpm for 5 minutes, using Henschel Mixer 20B made by Mitsui Mining Co., Ltd. The mixture was then hot kneaded in a double-shaft kneading extruder (PCM-30 made by Ikegai Kaseisha Co., Ltd.) to disperse and fix the additives in the resin. After rolled and cooled down, the kneaded product was crushed through a feather mill to 2 mm mesh pass.

Then, the crushed product was finely ground using a jet mill (200APG made by Hosokawa Micron Co., Ltd.), and classified by a pneumatic classifier (100ATP made by Hosokawa Micron Co., Ltd.) to obtain colored resin particles having an average particle diameter of 6 μm.

Using a hot-air spheronizer (Surfusing System SFS-3 Type made by Nippon Pneumatic Kogyo Co., Ltd.), the obtained colored resin particles were heat treated under the following conditions. The inlet hot-air temperature was 320° C., the time of contact of the particles with hot air was 0.03 seconds, the flow rate of hot air was 12.3 m/s., and the input of the raw feed per unit area was 1.0 kg/hr. Thus, colored resin particles having an average particle diameter of 6.3 μm and a circularity of 0.97 were obtained.

One hundred (100) parts by weight of the thus heat-treated colored resin particles and 0.5 parts by weight of silica fine particles (Cabseal TG810G made by Cabot Co., Ltd. and having a particle diameter of 10 nm) surface treated with hexamethyldisilazane were uniformly mixed at 2,800 rpm for 2 minutes for extraneous addition of the silica fine particles, using Henschel Mixer 20B (made by Mitsui Mining Co., Ltd.), thereby obtaining the first electrophotographic dry toner of the present invention.

Before the extraneous addition, a 100-μm wide section cut out of the heat-treated particle was observed under a scanning electron microscope of 40,000 magnifications. As can be seen from FIG. 1, about 70 white releasing agent particles of about 0.1 mm in diameter are scattered in a layer of the colored resin particle from its surface to a depth of about 0.8 μm while in a central layer from the depth of 0.8 μm to the innermost releasing agent particles are so closely packed that they cannot individually be identified. In FIG. 1, the toner particle is in an oval form probably due to deformation incidental to cutting, and the toner particle is shown to have two large white spots probably due to partial defoliation incidental to cutting.

The electrophotographic dry toner obtained in Example 1 had a high-temperature offsetting temperature of 200° C., a low-temperature offsetting temperature of 110° C. and a non-offset width of 90° C. A HAZE value of 25 was obtained and filming onto a developing roller did not occur even after the lapse of 8 hours.

EXAMPLE 2

An electrophotographic dry toner was prepared by obtaining colored resin particles having an average particle diameter of 6 μm at the classification step, heat-treating them into colored resin particles having an average particle diameter of 6.2 μm and a circularity of 0.97 and carrying out extraneous addition in the same manners as in Example 1 with the exception that a 50:50 mixture (by weight) (made by Sanyo Kasei Co., Ltd. with a Tg of 61° C., a flow softening point (Tf) of 126° C., an acid number of 5 and a hydroxyl number of 30) of a polycondensed polyester of an aromatic dicarboxylic acid and alkylene etherified bisphenol A, and a partially crosslinked product of said polycondensed polyester by a polyvalent metal compound was used instead of the binder resin in the colored resin particle composition of Example 1.

Observation of a sectional shape of the obtained colored resin particle under a scanning electron microscope has indicated that wax particles are similarly dispersed in the section.

The thus obtained electrophotographic dry toner had a high-temperature offsetting temperature of 200° C., a low-temperature offsetting temperature of 110° C. and a non-offset width of 70° C. A HAZE value of 28 was obtained and filming onto a developing roller did not occur even after the lapse of 8 hours.

EXAMPLE 3

One hundred (100) parts by weight of the colored resin particles having an average particle diameter of 6 μm, which were obtained by pneumatic classification in Example 1, and 15 parts by weight of encapsulating fine particles made up of a styrene-acrylic copolymer produced by emulsion polymerization and having a Tg of 65° C., a flow softening point of 145° C., a particle diameter of 0.25 μm, a weight-average molecular weight of 30,000 and a number-average molecular weight of 10,000 were microscopically mixed together at a rotor revolution speed of 90 m/s. for 5 minutes, using Hybridizer NHS-1 (Nara Kikai Seisakusho Co., Ltd.) to deposit the encapsulating fine particles onto the colored resin particles.

Then, the colored resin particles with the encapsulating fine particles deposited onto them were heat treated using a hot-air spheronizer "Surfusing System SFS-3 Type" made by Nippon Pneumatic Industries, Ltd., thereby obtaining colored resin particles having an average particle diameter of 6.3 μm and a circularity of 0.98. The applied conditions were that the inlet hot-air temperature was 320° C., the time of contact of the particles with hot air was 0.05 seconds, the flow rate of hot air was 13.2 m/s., and the input per unit area was 1.0 kg/hr. Subsequently, the extraneous addition treatment was carried out as in Example 2, thereby obtaining the second electro-photographic dry toner according to the present invention.

Observation of a sectional shape of the colored resin particle before the extraneous addition treatment under a scanning electron microscope as in Example 1 indicated that the resin coating layer was 0.18 μm in thickness and in the colored resin particle there was a similar wax particle dispersion as in Example 1.

The thus obtained electrophotographic dry toner had a high-temperature offsetting temperature of 200° C., a low-temperature offsetting temperature of 130° C. and a non-offset width of 70° C. A HAZE value of 30 was obtained with no filming onto a developing roller even after the lapse of 10 hours.

EXAMPLE 4

Encapsulating fine particles were deposited onto 100 parts by weight of the colored resin particles having an average particle diameter of 6 μm as in Example 3, which particles were obtained by classification in Example 2. Then, the particles were heat treated as in Example 3, thereby obtaining colored resin particles having an average particle diameter of 6.2 μm and a circularity of 0.97. Subsequently, the extraneous addition treatment was carried out as in Example 3, thereby obtaining the second electrophotographic dry toner according to the present invention.

Observation of a sectional shape of the colored resin particle before the extraneous addition treatment under a scanning electron microscope as in Example 3 indicated that the resin coating layer was 0.20 μm in thickness and in the colored resin particle coated with the resin coating layer there was a similar wax particle dispersion as in Example 1.

The thus obtained electrophotographic dry toner had a high-temperature offsetting temperature of 200° C., a low-temperature offsetting temperature of 130° C. and a non-offset width of 70° C. A HAZE value of 31 was obtained with no filming onto a developing roller even after the lapse of 10 hours.

COMPARATIVE EXAMPLE 1

The colored resin particles having an average particle diameter of 6 μm, obtained by classification in Example 1, were heat treated using a hot-air spheronizer "Surfusing System SFS-3 Type" made by Nippon Pneumatic Industries, Ltd. under the same conditions (for instance, the inlet hot-air temperature was 320° C.) as in Example 1 with the exception that the time of contact of the particles with hot-air was reduced to $8\times10^{-3}$ seconds, thereby obtaining colored resin particles having an average particle diameter of 6.2 μm and a circularity of 0.88.

Observation of a section of the heat-treated particle under a scanning electron microscope of 40,000 magnifications indicated that the releasing agent particles were closely packed both in the colored resin particle and in the vicinity of its surface.

Subsequently, the extraneous addition treatment was carried out as in Example 1, thereby obtaining a comparative dry toner for electrophotography, which was then similarly evaluated. The obtained electrophotographic dry toner had a high-temperature offsetting temperature of 180° C., a low-temperature offsetting temperature of 140° C. and a non-offset width of 40° C. The HAZE value was as low as 31, but filming onto a developing roller was found one hour after the driving of a developing unit.

COMPARATIVE EXAMPLE 2

The colored resin particles with encapsulating fine particles deposited onto them as in Example 3 were heat treated using a hot-air spheronizer "Surfusing System SFS-3 Type" made by Nippon Pneumatic Industries, Ltd. under the same conditions (for instance, the inlet hot-air temperature was 320°0 C.) as in Example 3 with the exception that the time of contact of the particles with hot air was extended to 1 second, thereby obtaining colored resin particles having an average particle diameter of 6.3 μm and a circularity of 0.99.

Observation of a section of the heat-treated particle under a scanning electron microscope of 40,000 magnifications indicated that the releasing agent bled at the surface of the colored resin particle.

Subsequently, the extraneous addition treatment was carried out as in Example 3, thereby obtaining a comparative dry toner for electrophotography, which was then similarly evaluated. The obtained electrophotographic dry toner had a high-temperature offsetting temperature of 180° C., a low-temperature offsetting temperature of 140° C. and a non-offset width of 40° C. The HAZE value was as high as 56, and filming onto a developing roller was found one hour after the driving of a developing unit.

COMPARATIVE EXAMPLE 3

The colored resin particles having an average particle diameter of 6 μm, obtained at the classification step in Example 1, were heat treated using a hot-air spheronizer "Surfusing System SFS-3 Type" under the same conditions (for instance, the time of contact of the particles with hot air was 0.03 seconds) as in Example 1 with the exception that the inlet hot-air temperature was changed to 150° C., thereby obtaining colored resin particles having an average particle diameter of 6.1 μm and a circularity of 0.92.

One hundred (100) parts by weight of the obtained colored resin particles and 15 parts by weight of the encapsulating fine particles used in Example 3 were microscopically mixed together at a rotor revolution speed of 90 m/s. for 5 minutes, using Hybridizer NHS-1 (made by Nara Kikai Seisakusho Co., Ltd.) to deposit the encapsulating fine particles onto the colored resin particles, thereby obtaining colored resin particles having an average particle diameter of 6.4 μm and a circularity of 0.94.

Observation of a section of the colored resin particle with the encapsulating fine particles deposited onto it under a scanning electron microscope of 40,000 magnifications indicated that unlike the dispersion of the releasing agent particles in the present invention, the releasing agent particles were closely packed both in the colored resin particle and in the vicinity of its surface.

Subsequently, the extraneous addition treatment was carried out as in Example 1, thereby obtaining a comparative dry toner for electrophotography, which was then similarly evaluated. The obtained electrophotographic dry toner had a high-temperature offsetting temperature of 180° C., a low-temperature offsetting temperature of 140° C. and a non-offset width of 40° C. The HAZE value was 26, and filming onto a developing roller did not occur even after the lapse of 8 hours.

The third electrophotographic dry toner of the present invention and its production process are now explained with reference to Examples 5–6 and Comparative Example 4.

EXAMPLE 5

Binder resin: 100 parts by weight

This binder resin was a styrene-butyl acrylate copolymer having a glass transition temperature (Tg) of 56° C., a flow softening point (Tf) of 115° C., a weight-average molecular weight of $5\times10^4$ and a number-average molecular weight of $4\times10^3$.

Coloring master batch: 40 parts by weight

This master batch was a mixture consisting of 70 parts by weight of the aforesaid binder resin and 30 parts by weight of Permanent Red F2R, C. I. 12310.

Negative chargeable charge control agent: 1 part by weight

This charge control agent was an oxo-gluco compound ("Copy Charge NCA cp2243" made by Clariant Co., Ltd.).

Releasing agent: 3 parts by weight

For the releasing agent, a polywax having a melting point of 128° C., i.e., Hoechst Wax PE130 made by Hoechst Co., Ltd. was used.

The aforesaid composition was uniformly mixed together at 2,800 rpm for 5 minutes, using Henschel Mixer 20B made by Mitsui Mining Co., Ltd. The mixture was then hot kneaded in a double-shaft kneading extruder (PCH-30 made by Ikegai Kaseisha Co., Ltd.) to disperse and fix the additives in the resin. After allowed to stand for cooling, the kneaded product was crushed through a feather mill to 2 mm mesh pass.

Then, the crushed product was finely ground using a jet mill (200APG made by Hosokawa Micron Co., Ltd.), and classified by a pneumatic classifier (100ATP made by Hosokawa Micron Co., Ltd.) to obtain colored resin particles having an average particle diameter of 6 μm.

One hundred (100) parts by weight of the classified colored resin particles and 15 parts by weight of encapsulating fine particles made up of a styrene-acrylic copolymer prepared by soap-free emulsion polymerization (with a Tg of 65° C., a flow softening point of 145° C., a particle diameter of 0.25 μm, a weight-average molecular weight of 30,000 and a number-average molecular weight of 10,000) were microscopically mixed together at a rotor revolution speed of 90 m/s. for 5 minutes, using Hybridizer NHS-1 (made by Nara Kikai Seisakusho Co., Ltd.), thereby depositing the encapsulating fine particles onto the colored resin particles.

Using a hot-air spheronizer (Surfusing System SFS-3 Type made by Nippon Pneumatic Kogyo Co., Ltd.), the obtained colored resin particles were heat treated under the following conditions. The inlet hot-air temperature was 320° C., the time of contact of the particles with hot air was 0.03 seconds, the flow rate of hot air per unit area was 1.3 $m^3$/s., and the input of the raw feed per unit area was 1.0 kg/hr. Thus, colored resin particles having an average particle diameter of 6.3 μm and a circularity of 0.97 were obtained.

The composition of the heat-treated colored resin particle was analyzed in its depth-wise direction, using a TOF-SIMS (a time-of-flight type secondary ion mass spectrometer), i.e., TRIFT-2000 made by Alback Phi Co., Ltd.). Consequently, it was found that the resin coating layer was 0.18 μm while the releasing agent layer was 0.006 μm. The fact that the intermediate layer beneath the resin coating layer was the releasing agent layer was confirmed by the detection of an increase in olefin-derived CH.

One hundred (100) parts by weight of the thus heat-treated colored resin particles and 0.5 parts by weight of silica fine particles (R-972 made by Nippon Aerosil co., Ltd. and having a particle diameter of 14 μm) made hydrophobic on their surfaces were uniformly mixed at 2,800 rpm for 2 minutes for extraneous addition of the silica fine particles, using Henschel Mixer 20B (made by Mitsui Mining Co., Ltd.), thereby obtaining the electrophotographic dry toner of the present invention.

The obtained electrophotographic dry toner had a high-temperature offsetting temperature of 210° C., a low-temperature offsetting temperature of 110° C. and a non-offset width of 100° C. A HAZE value of 32 was obtained and filming onto a developing roller did not occur even after the lapse of 8 hours.

EXAMPLE 6

An electrophotographic dry toner was prepared as in Example 5 with the exception that a 50:50 mixture (by weight) (made by Sanyo Kasei Co., Ltd. with a Tg of 61° C., a flow softening point (Tf) of 126° C., an acid number of 5 and a hydroxyl number of 30) of a polycondensed polyester of an aromatic dicarboxylic acid and alkylene etherified bisphenol A, and a partially crosslinked product of said polycondensed polyester by a polyvalent metal compound was used instead of the binder resin in the colored resin particle composition of Example 5.

The composition of the heat-treated particle was analyzed as in Example 5 in its depth-wise direction. It was consequently found that the releasing coating layer was 0.17 μm and the releasing agent layer was 0.004 μm.

As a result of evaluation of the properties of an electrophotographic dry toner prepared as in Example 5, it was found to have a high-temperature offsetting temperature of 200° C., a low-temperature offsetting temperature of 110° C. and a non-offset width of 90° C. A HAZE value of 31 was obtained and filming onto a developing roller did not occur even after the lapse of 10 hours.

COMPARATIVE EXAMPLE 4

Heat-treated particles having an average particle diameter of 6.2 μm and a circularity of 0.98 were prepared as in Example 5 with the exception that the colored resin particles were heat treated using the hot-air spheronizer ("Surfusing System" made by Nippon Pneumatic Industries, Ltd.) under the same conditions with the exception that the time of contact of the particles with hot air was extended to 1.0 second. A depth-wise composition analysis of the heat-treated particle as in Example 5 indicated that the resin coating layer was 0.15 μm and the releasing agent was found to bleed at the surface of the particle.

As a result of evaluation of the properties of an electrophotographic dry toner prepared as in Example 5, it was found to have a high-temperature offsetting temperature of 210° C., a low-temperature offsetting temperature of 120° C. and a non-offset width of 90° C. A HAZE value of 33 was obtained and filming onto a developing roller occurred after the lapse of 0.5 hours.

EXAMPLE 7

Binder resin: 100 parts by weight

This binder resin was a styrene-butyl acrylate copolymer having a glass transition temperature (Tg) of 56° C., a flow softening point (Tf) of 115° C., a weight-average molecular weight of $5\times10^4$ and a number-average molecular weight of $4\times10^3$.

Coloring master batch: 40 parts by weight

This master batch was a mixture consisting of 70 parts by weight of the aforesaid binder resin and 30 parts by weight of Permanent Red F2R, C. I. 12310.

Negative-chargeable charge control agent: 1 part by weight

This charge control agent was an oxo-gluco compound ("Copy Charge NCA cp2243" made by Clariant Co., Ltd.).

Releasing agent: 3 parts by weight

For the releasing agent, a polywax having a melting point of 128° C., i.e., Hoechst Wax PE130 made by Hoechst Co., Ltd. was used.

The aforesaid composition was uniformly mixed together at 2,800 rpm for 5 minutes, using Henschel Mixer 20B made by Mitsui Mining Co., Ltd. The mixture was then hot kneaded in a double-shaft kneading extruder (PCH-30 made by Ikegai Kaseisha Co., Ltd.) to disperse and fix the additives in the resin. After allowed to stand for cooling, the kneaded product was crushed through a feather mill to 2 mm mesh pass.

Then, the crushed product was finely ground using a jet mill (200APG made by Hosokawa Micron Co., Ltd.), and classified by a pneumatic classifier (100ATP made by Hosokawa Micron Co., Ltd.) to obtain colored resin particles having an average particle diameter of 6 μm. using a hot-air spheronizer (Surfusing System SFS-3 Type made by Nippon Pneumatic Kogyo Co., Ltd.), the obtained colored resin particles were heat treated under the following conditions. The inlet hot-air temperature was 320° C., the time of contact of the particles with hot air was 0.03 seconds, the flow rate of hot air per unit area was 0.7 $M^3$/s., and the input of the raw feed per unit area was 1.0 kg/hr. The composition of the heat-treated colored resin particle was analyzed in its depth-wise direction, using a TOF-SIMS (a time-of-flight type secondary ion mass spectrometer), i.e., TRIFT-2000 made by Alback Phi Co., Ltd.). Consequently, it was found that the releasing agent layer was 0.004 μm. The fact that this was a releasing agent layer was confirmed by the detection of an increase in olefin-derived CH.

One hundred (100) parts by weight of the colored resin particles with the releasing agent layers formed on their surfaces and 15 parts by weight of encapsulating fine particles made up of a styrene-acrylic copolymer prepared by soap-free emulsion polymerization (with a Tg of 65° C., a flow softening point of 145° C., a particle diameter of 0.25 μm, a weight-average molecular weight of 30,000 and a number-average molecular weight of 10,000) were microscopically mixed together at a rotor revolution speed of 90 m/s. for 5 minutes, using Hybridizer NHS-1 (made by Nara Kikai Seisakusho Co., Ltd.), thereby depositing the encapsulating fine particles onto the colored resin particles and obtaining encapsulated colored resin particles having an average particle diameter of 6.3 μm and a circularity of 0.97. The resin coating layers were found to have a thickness of 0.18 One hundred (100) parts by weight of the encapsulated colored resin particles and 0.5 parts by weight of silica fine particles (R-972 made by Nippon Aerosil Co., Ltd. and having a particle diameter of 14 μm) made hydrophobic on their surfaces were uniformly mixed at 2,800 rpm for 2 minutes for extraneous addition of the silica fine particles, using Henschel Mixer 20B (made by Mitsui Mining Co., Ltd.), thereby obtaining the electrophotographic dry toner of the present invention.

The obtained electrophotographic dry toner had a high-temperature offsetting temperature of 210° C., a low-temperature offsetting temperature of 105° C. and a non-offset width of 105° C. A HAZE value of 31 was obtained and filming onto a developing roller did not occur even after the lapse of 12 hours. By measurement, the amount of free fine powders was found to be 1.1% (number base percentage).

EXAMPLE 8

An electrophotographic dry toner was prepared as in Example 7 with the exception that a 50:50 mixture (by weight) (made by Sanyo Kasei Co., Ltd. with a Tg of 61° C., a flow softening point (Tf) of 126° C., an acid number of 5 and a hydroxyl number of 30) of a polycondensed polyester of an aromatic dicarboxylic acid and alkylene etherified bisphenol A, and a partially crosslinked product of said polycondensed polyester by a polyvalent metal compound was used instead of the binder resin in the colored resin particle composition of Example 7. Thereafter, similar heat treatment was carried out to obtain heat-treated particles with 0.002 μm thick releasing agent layers formed on their surfaces.

The heat-treated particles were encapsulated as in Example 7 to obtain encapsulated particles with 0.17 μm thick releasing agent layers formed thereon, which were then formed into an electrophotographic dry toner. As a result of evaluation of the properties of the electrophotographic dry toner, it was found to have a high-temperature offsetting temperature of 200° C., a low-temperature offsetting temperature of 105° C. and a non-offset width of 95° C. A HAZE value of 30 was obtained and filming onto a developing roller did not occur even after the lapse of 15 hours. By measurement, the amount of free fine powders was found to be 1.3% (number-base percentage).

COMPARATIVE EXAMPLE 5

Heat-treated particles having an average particle diameter of 6.1 μm and a circularity of 0.94 were prepared as in Example 7 with the exception that the colored resin particles were heat treated using the hot-air spheronizer ("Surfusing System" made by Nippon Pneumatic Industries, Ltd.) under the same conditions with the exception that the time of contact of the particles with hot air was reduced to 0.01 second. A depth-wise composition analysis of the heat-treated particle as in Example 7 indicated that no substantial releasing agent layer was found; the releasing agent bled at a part of the surface of the heat-treated particle.

As a result of evaluation of the properties of an electrophotographic dry toner prepared as in Example 7, it was found to have a high-temperature offsetting temperature of 190° C., a low-temperature offsetting temperature of 110° C. and a non-offset width of 80° C. A HAZE value of 32 was obtained and filming onto a developing roller occurred after the lapse of 0.5 hours. By measurement, the amount of free fine powders was found to be 26.5% (number-base percentage).

INDUSTRIAL APPLICABILITY

The present invention is directed to electrophotographic dry toners and their production processes. With this invention, it is possible to provide electrophotographic dry toners especially suitable for color toners, which prevent contamination by filming of process members such as photosensitive materials and developers, and are much more improved in terms of offset resistance on fixation and robustness and transparency with a much more reduced amount of free fine powders, and their production processes.

What we claim is:

1. A dry toner for electrophotography comprising:

colored resin particles obtained by hot-kneading and grinding of a binder resin, a releasing agent and a coloring agent, with releasing agent particles dispersed in a binder resin, wherein the releasing agent particles dispersed in each colored resin particle have a particle diameter distribution such that the particle diameter of releasing agent particles dispersed in the vicinity of the surface of each colored resin particle is larger than the particle diameter of all releasing agent particles at a central site of the colored resin particle, and the colored resin particles have an average particle diameter of 3 μm to 10 μm and a circularity of 0.93 to 0.99, and the releasing agent particles dispersed in the vicinity of the surface of each colored resin particle have a particle diameter of 0.05 μm to 0.3 μm.

2. A dry toner for electrophotography comprising colored resin particles obtained by hot-kneading and grinding of a binder resin, a releasing agent and a coloring agent, with releasing agent particles dispersed in a binder resin, and having an encapsulating resin particles fixed and fused to the surface of each colored resin particle to form a resin coating layer, wherein:

the releasing agent particles dispersed in each colored resin particle have a particle diameter distribution such that the particle diameter of releasing agent particles dispersed in the vicinity of the surface of each colored resin particle is larger than the particle diameter of all releasing agent particles at a central site of the colored resin particle, and the colored resin particles have an average particle diameter of 3 μm to 10 μm and a circularity of 0.93 to 0.99, the releasing agent particles dispersed in the vicinity of the surface of each colored resin particle have a particle diameter of 0.05 μm to 0.3 μm, and the resin coating layer having a thickness of 0.05 μm to 1 μm.

3. The dry toner for electrophotography according to claim 2, wherein each encapsulating resin particle is a soap-free emulsion polymerized particle.

4. The dry toner for eletrophotography according to claims 2 or 3 wherein the binder resin has a flow softening point of 100° C. to 150° C., there is a difference of up to ±30° C. between the softening point of the releasing agent and the flow softening point of the binder resin, and the flow softening temperature of the resin coating layer is at least 5° C. higher than the flow softening temperature of the binder resin.

5. A process for producing an electrophotographic dry toner, which comprises the steps of adding 0.5 parts by weight to 10 parts by weight of a releasing agent non-compatible with a binder resin to 100 parts by weight of the binder resin and dispersing the releasing agent therein with a coloring agent added thereto, then hot-kneading and grinding the resultant dispersion into colored resin particles, and then treating the colored resin particles in a hot-air stream for their re-dispersion so that the releasing agent particles dispersed in each colored resin particle have a particle diameter distribution such that the particle diameter of releasing agent particles dispersed in the vicinity of the surface of each colored resin particle is larger than the particle diameter of releasing agent particles at a central site of the colored resin particle, thereby obtaining a structure wherein the colored resin particles have an average particle diameter of 3 μm to 10 μm and a circularity of 0.93 to 0.99, and the releasing agent particles dispersed in the vicinity of the surface of each colored resin particle have a particle diameter of 0.05 μm to 0.3 μm.

6. A process for producing an electrophotographic dry toner, which comprises the steps of adding 0.5 parts by weight to 10 parts by weight of a releasing agent non-compatible with a binder resin to 100 parts by weight of the binder resin and dispersing the releasing agent therein with a coloring agent added thereto, then hot-kneading and grinding the resultant dispersion into colored resin particles, then uniformly fixing encapsulating resin particles onto the surface of the colored resin particles by mechanical impact or a dry mechanochemical method, and finally treating the colored resin particles in a hot-air stream for re-dispersion, so that the encapsulating resin particles are fused onto the surface of the colored resin particles to form a resin coating layer thereon, and the releasing agent particles dispersed in each colored resin particle have a particle diameter distribution such that the particle diameter of releasing agent particles dispersed in the vicinity of the surface of each colored resin particle is larger than the particle diameter of releasing agent particles at a central site of the colored resin particle, thereby obtaining a structure wherein the colored resin particles have an average particle diameter of 3 μm to 10 μm and a circularity of 0.93 to 0.99, the releasing agent particles dispersed in the vicinity of the surface of each colored resin particle have a particle diameter of 0.05 μm to 0.3 μm and the resin coating layer having a thickness of 0.05 μm to 1 μm.

* * * * *